United States Patent [19]

Wiseman

[11] 4,162,733

[45] Jul. 31, 1979

[54] ARTICLE STACKING APPARATUS

[76] Inventor: Raymond L. Wiseman, 1550 S. Macon St., Aurora, Colo. 80012

[21] Appl. No.: 808,715

[22] Filed: Jun. 21, 1977

[51] Int. Cl.[2] ..... B65G 57/06

[52] U.S. Cl. ..... 414/78; 271/64; 271/218

[58] Field of Search ..... 214/6 H; 271/189, 190, 271/218, 64; 198/422, 796, 802, 482, 436, 437, 369, 358; 93/93 DP

[56] References Cited

U.S. PATENT DOCUMENTS

| | | | |
|---|---|---|---|
| 2,795,312 | 6/1957 | Howdle | 198/358 |
| 3,429,239 | 2/1969 | Murchison et al. | 271/218 |
| 3,515,260 | 6/1970 | Clyne | 198/796 |
| 3,617,055 | 11/1971 | Stal | 214/6 H |
| 3,664,482 | 5/1972 | Kornylak | 198/482 |
| 3,926,319 | 12/1975 | Neely, Jr. | 198/422 |

*Primary Examiner*—Albert J. Makay
*Assistant Examiner*—Ross Weaver
*Attorney, Agent, or Firm*—Fay & Sharpe

[57] ABSTRACT

Stacker apparatus includes a bottom support platform movable downwardly from an upper elevation for receiving and forming a stack of flat articles such as newspapers or the like. The support platform in its upper elevation first moves generally downwardly with snap acting intercept motion for intercepting the leading edge of a flat article to begin formation of a new stack. The support platform then moves downwardly with stack forming motion different from the intercept motion. An input mechanism feeding a stream of overlapped newspapers generally flatways into the stacker apparatus includes a dump gate for deflecting the stream of newspapers away from the stacker when a jam occurs.

33 Claims, 13 Drawing Figures

FIG. 11
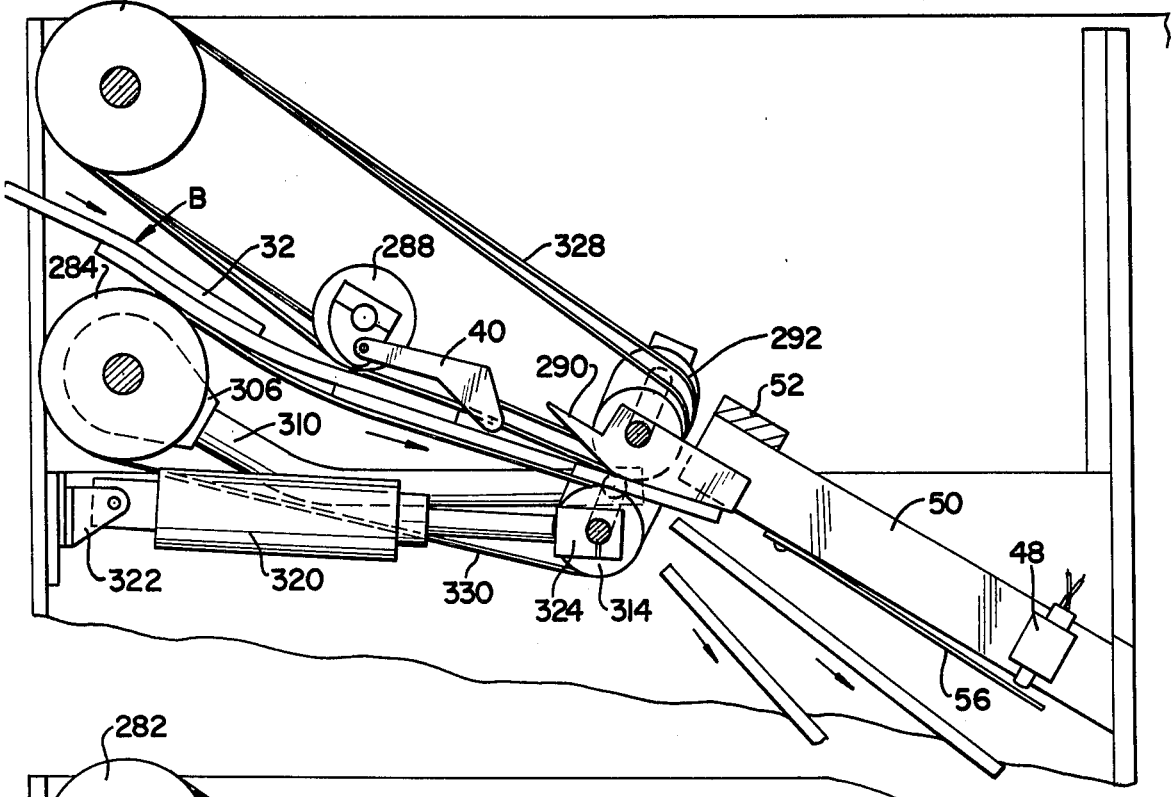
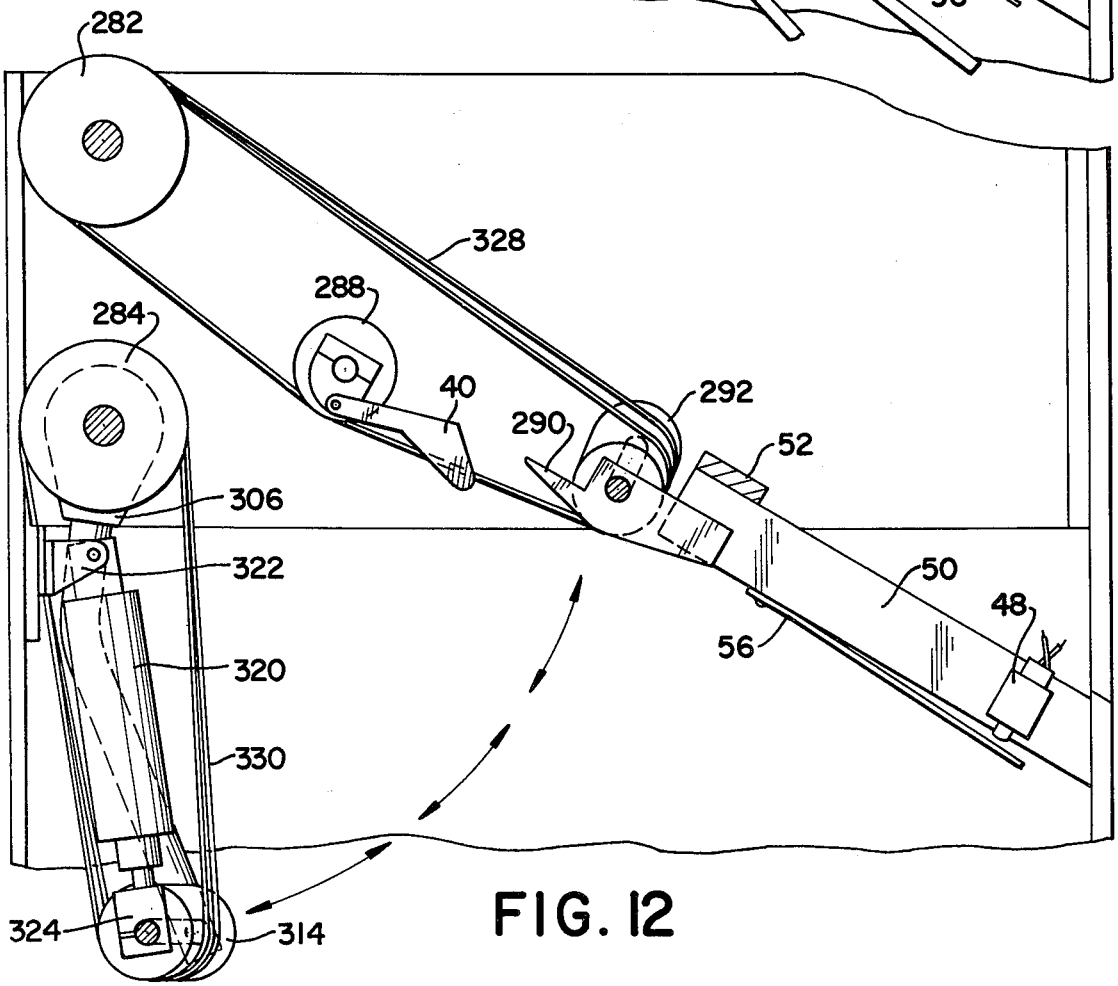
FIG. 12

ARTICLE STACKING APPARATUS

BACKGROUND OF THE INVENTION

This application relates to the art of article stacking and, more particularly, to stacking of generally flat articles. The invention is particularly applicable for use in stacking newspapers or the like and will be particularly described with respect thereto. However, it will be appreciated that certain aspects of the invention may be used in apparatus of other types.

Newspapers are discharged from modern presses in folded and overlapped relationship moving generally flatways is a continuous stream. The papers are received and stacked in stacker apparatus which must operate at very high speeds. The design and operation of the stacker apparatus is complicated due to the fact that newspapers and other similar flat articles vary in size, weight and conformity, and are not dimensionally stable. Movement of the papers is also influenced by rather subtle forces including air, static electricity and friction. Papers weighing only a few ounces or over one pound apiece must be handled at rates exceeding 20 per second, and at instantaneous rates exceeding 60 per second, in a continuous stream or flow often exceeding 1000 pounds per minute. This stream must be separated into accurately counted stacks at rates at least up to one stack per second. In normal operation, the continuous rapidly moving stream of papers places pressure on the stacker to perform flawlessly at extremely high stacking rates, and the stacker apparatus cannot skip or pause without instantly jamming itself, or jamming other related machinery.

Existing stacker apparatus has become very complicated in an attempt to achieve extremely high production speeds. It would be desirable to have a stacker apparatus which was characterized by its relative simplicity and high speed operation.

SUMMARY OF THE INVENTION

Stacker apparatus of the type described includes bottom support means movable downwardly from an upper elevation for receiving and forming a stack of flat articles moving generally flatways one after another transversely toward the stacker apparatus. The support means in its upper elevation is first movable generally downwardly with snap acting intercept motion for intercepting the leading edge of a flat article to begin formation of a new stack of such articles. The support means is then movable downwardly with stack forming motion different from the intercept motion.

The support means has a free outer end movable during the intercept motion with components both perpendicular to the movement direction of the flat articles and parallel along the movement direction of the flat articles.

In one arrangement, the support means is attached to a movable carrier. The support means moves relative to the carrier through its intercept motion and moves with the carrier through its stack forming motion. In a preferred arrangement, the support means swings in an arcuate path in its intercept motion and moves linearly downward in its stack forming motion.

Delay means is provided for delaying downward movement of the free outer end of the support means following movement thereof in its intercept motion. This allows the final paper of the previous stack to clear the next support means before substantial downward movement of the next support means begins after it has intercepted the leading edge of a paper to begin formation of a new stack.

The support means may be attached to a driven continuous chain for linear movement therewith in its stack forming motion, and for pivotal movement relative thereto in its intercept motion.

In an important aspect of the invention, the support means moves downwardly through a predetermined total distance from its upper elevation. The upper elevation in which the support means is capable of movement in its intercept motion extends over the uppermost portion of the predetermined total distance. This enables the support means to move in its intercept motion prior to reaching a precise poised position.

The support means is attached by a carrier or truck to a continuous flexible drive element extending around upper and lower wheels or sprockets. Drive means is provided for rotatably driving at least one of the wheels or sprockets. A fixed cam track generally follows the shape or path of the flexible drive element. The support means is pivoted to the carrier and has a cam follower. Biasing means normally biases the support means in a direction for engaging the cam follower with the cam track. The cam track extends sharply inwardly toward the upper wheel or sprocket to define an intercept cam portion facing generally toward the direction from which the papers move toward the stacker apparatus. The support means is movable in its intercept motion when the cam follower falls off the cam track onto the intercept cam track portion.

Cam latch means is provided for movement between a closed position continuing the cam track past the intercept cam track portion to block movement of the cam follower onto the intercept cam track portion, and an open position providing free movement of the cam follower onto the intercept cam track portion.

Drive control means is operated for stopping the drive means upon movement of the cam follower onto the cam latch means when the cam latch means is in its closed position. The drive control means is operated for starting the drive means upon movement of the cam follower onto the intercept cam track portion with the cam latch means in its open position.

Stop means is provided for stopping the cam follower at a predetermined poised position for the support means in the event the cam latch has not moved to its open position prior to the cam follower reaching the stop means. The stop means may be in the form of an anvil, and a kicker is provided for aiding movement of the cam follower off from the anvil toward the intercept cam track portion when the cam latch means moves to its open position. Movement of the kicker may operate the drive control means.

The cam latch means is operated by a fluid cylinder energized by a pulse from a counter when a predetermined number of flat articles has moved past the counter for reception on the support means.

The cam track includes a delay cam track portion to provide the delay means for delaying downward movement of the outer free end of the support means immediately following its intercept motion. The bottom portion of the cam track also has a discharge cam track portion to provide relatively rapid lateral and dropping movement of the outer end portion of the support means to at least partially rotate the stack so it will be approximately level upon reaching the turntable.

The drive mechanism of the stacker apparatus includes a yieldable idler normally biased in a direction for tensioning the flexible drive element or chain. The momentum of the moving parts is absorbed by movement of the movable spring biased idler and this greatly simplifies the drive mechanism as compared to rigid systems.

An input mechanism is provided for guiding a stream of overlapped folded papers or other flat articles flatways into the stacker apparatus. The input guide mechanism includes upper and lower roller assemblies having flexible elements trained therearound. At least certain of the rollers are driven for driving the flexible elements to feed the papers or other flat articles into the stacker apparatus. A lower roller assembly defines a dump gate and is downwardly pivotable to define a dump gate for deflecting papers away from the stacker apparatus in the event of a jam. Various sensing devices may be provided on the stacker apparatus and input mechanism for sensing a jam condition and operating the dump gate to move same from its upper feeding position to its lower dumping position. The dump gate may move back to its normal operating position automatically when the jamming condition no longer exists.

The dump gate may be in the form of opposed trunnions mounted on the shaft of a lower rear roller on the input mechanism and having arms extending outwardly toward the stacker apparatus for supporting forward rolls. A fluid cylinder normally holds the arms generally horizontal for locating the forward lower rolls closely adjacent beneath upper forward rolls. In the event of a jam condition, the fluid cylinder operates for swinging the trunnions and lowering the arms to a generally vertical position whereupon the papers strike a deflector mounted on the stacker apparatus. When the jam condition no longer exists, the fluid cylinder operates automatically for moving the arms back to their generally horizontal position for locating the forward lower rollers closely beneath the forward upper rollers.

It is a principal object of the present invention to provide an improved stacker apparatus for receiving and stacking flat articles.

It is also an object of the present invention to provide an improved stacker apparatus having support means movable in an improved intercept motion.

It is another object of the invention to provide stacker apparatus which is characterized by its simplicity and high speed operation.

It is an additional object of the invention to provide a stacker apparatus with a drive mechanism which is capable of absorbing momentum of moving parts.

It is a further object of the invention to provide a stacker apparatus with a drive mechanism which is not rigid in order to eliminate elaborate drive mechanisms by making the mechanism a moving mass allowing energy to be absorbed and dissipated during deceleration.

It is another object of the invention to provide a stacker apparatus with an improved input mechanism having a dump gate for deflecting flat articles away from the stacker when a jam condition exists.

It is another object of the invention to provide an improved input mechanism having a dump gate which automatically moves back to an operative position when a jam condition has been corrected.

BRIEF DESCRIPTION OF THE DRAWING

The invention may take physical form in certain parts and arragements of parts, a preferred embodiment of which will be described in this specification and illustrated in the accompanying drawings which form a part hereof and wherein:

FIG. 11 is a cross-sectional side elevational view taken generally on lines 11—11 of FIG. 10;

FIG. 12 is a view similar to FIG. 11 and showing a dump gate in its downward dump position; and, FIG. 13 is a partial cross-sectional elevational view taken generally on lines 13—13 of FIG. 10.

DESCRIPTION OF A PREFERRED EMBODIMENT

Figure 1:
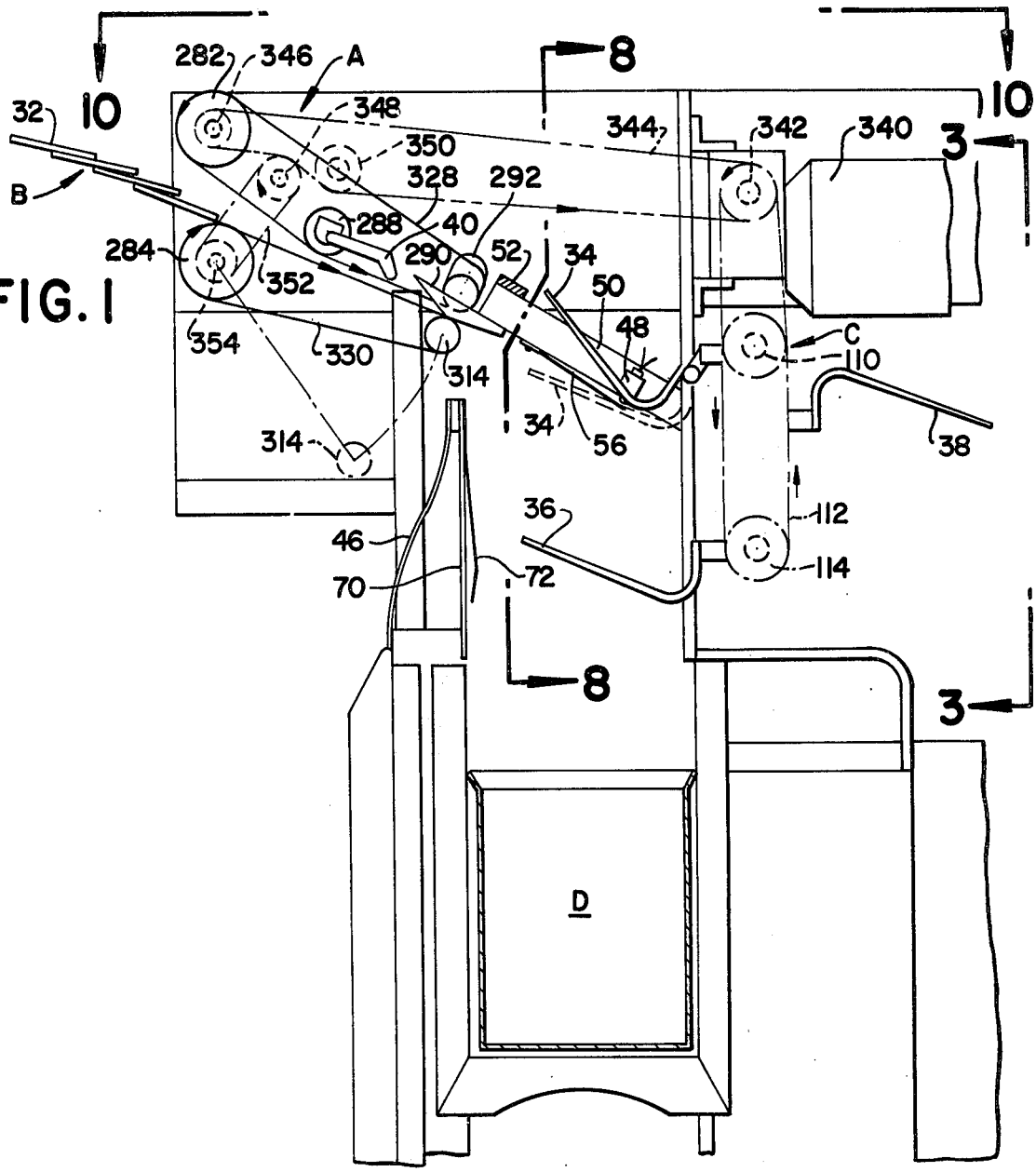
FIG. 1 is a somewhat diagrammatic side elevational view of a stacker apparatus constructed in accordance with the present invention and with portion omitted for clarity of illustration.

With reference to the drawings, wherein the showings are for purposes of illustrating the preferred embodiment of the invention only and not for purposes of limiting same, FIG. 1 shows a stacker apparatus including an input mechanism A through which a continuous flow or stream B of flat articles moves. Flat articles 32 forming stream B may be folded newspapers or the like and are moving flatways one after another in an overlapped condition. When the flat articles are folded newspapers, the leading edges are folded.

A stacker section C of the stacker apparatus includes bottom support means 34,36 and 38 movable downwardly from an upper position or upper elevation generally shown for support means 34 toward a lower position or elevation shown for support means 36. Support means 34 swings with snap acting intercept motion from the solid line position to the dotted line position for intercepting the leading edge of a flat article and beginning formation of a new stack after a predetermined number of papers have been received on support means 36. The drive mechanism of the stacker section then operates for moving the support means so that support means 38 will move into the position occuppied by support means 34; support means 34 will move into the position occupied by support means 36; and support means 36 will move into the position occupied by support means 38.

A counting device 40 counts papers moving through input mechanism A and signals an operating means for a latch means to provide swinging movement of support means 34 in its intercept motion. The signal may be delayed slightly and the mechanism is adjusted so that movement of support means 34 through its intercept motion causes it to intercept the leading edge of a predetermined paper for separating same from the last paper of the previous stack which then falls onto the formed stack on support means 36.

When support means 34 moves in its intercept motion, a drive control means is operated for energizing the drive mechanism for driving the chain or other flexible drive element 112 in a direction for moving the support means downwardly as previously described.

Stacks dropped from the support means in the stacker section fall onto a turntable D which is rotatable 180° for forming bundles of reversely positioned stacks. A discharge mechanism is provided in a known manner for discharging the stacks from turntable D.

The lower roller assembly of input mechanism A is lowerable to define a dump gate which is lowerable to the dotted line dumping position shown so that papers will strike against a deflector plate 46 secured to the frame of the apparatus between the input mechanism and stacker section C. The deflected papers will simply fall onto the floor so they will not interfere with subsequent operation of the stacker apparatus. Dumping of the gate may take place automatically by providing suitable sensing devices for sensing a jam condition including misalignment or the like. One device for sensing a jam condition is shown in the form of a switch 48 mounted on a support 50 extending from a cross brace 52. An elongated leaf spring member 56 mounted to the under side of support member 50 overlaps an operating button on switch 48. When support means 34 moves in its intercept motion from the solid line position to the dotted line position, papers begin stacking on support means 34 beneath support 50. In the event the drive mechanism for the stacker does not operate or another jam has occurred, the papers stacking up on support means 34 will deflect leaf spring 56 toward support 50 to operate switch 48 for energizing a fluid cylinder and swinging the bottom roller assembly defining the dump gate to the dotted position shown for deflecting papers off deflector 46. When the jam no longer exists, as when the drive mechanism moves so that support means 34 moves downwardly to occupy the position occupied by support means 36, switch 48 will again operate due to leaf spring 56 moving away from support 50 so that the fluid cylinder associated with the lower roller assembly or dump gate of the input mechanism will operate for automatically bringing the dump gate back to its normal operating feeding position so that stream B of flat articles will again be fed into the stacker section for interception and stacking.

Braces 70 are bolted or otherwise secured to the frame of the stacker apparatus and to the upper end of the relatively wide deflector plate 46 for bracing same. Leaf springs 72 are secured at their upper ends to the upper end portions of supports 70 and deflector plate 46, and bow outwardly for engaging the trailing edges of papers falling onto a stack supported by any of the support means. Engagement of a trailing edge of a paper with springs 72 will urge the paper along the stack so that all of the papers are aligned. For example, friction between papers may prevent a top paper from moving completely down on the stack and springs 72 will aid such movement when a paper does hang up. In addition, springs 72 and braces 70 aid in shifting the papers in an inclined stack when the stack is dumped so that the papers rotate, shift and fall onto turntable D in a generally rectangular vertical stack.

Figure 2:
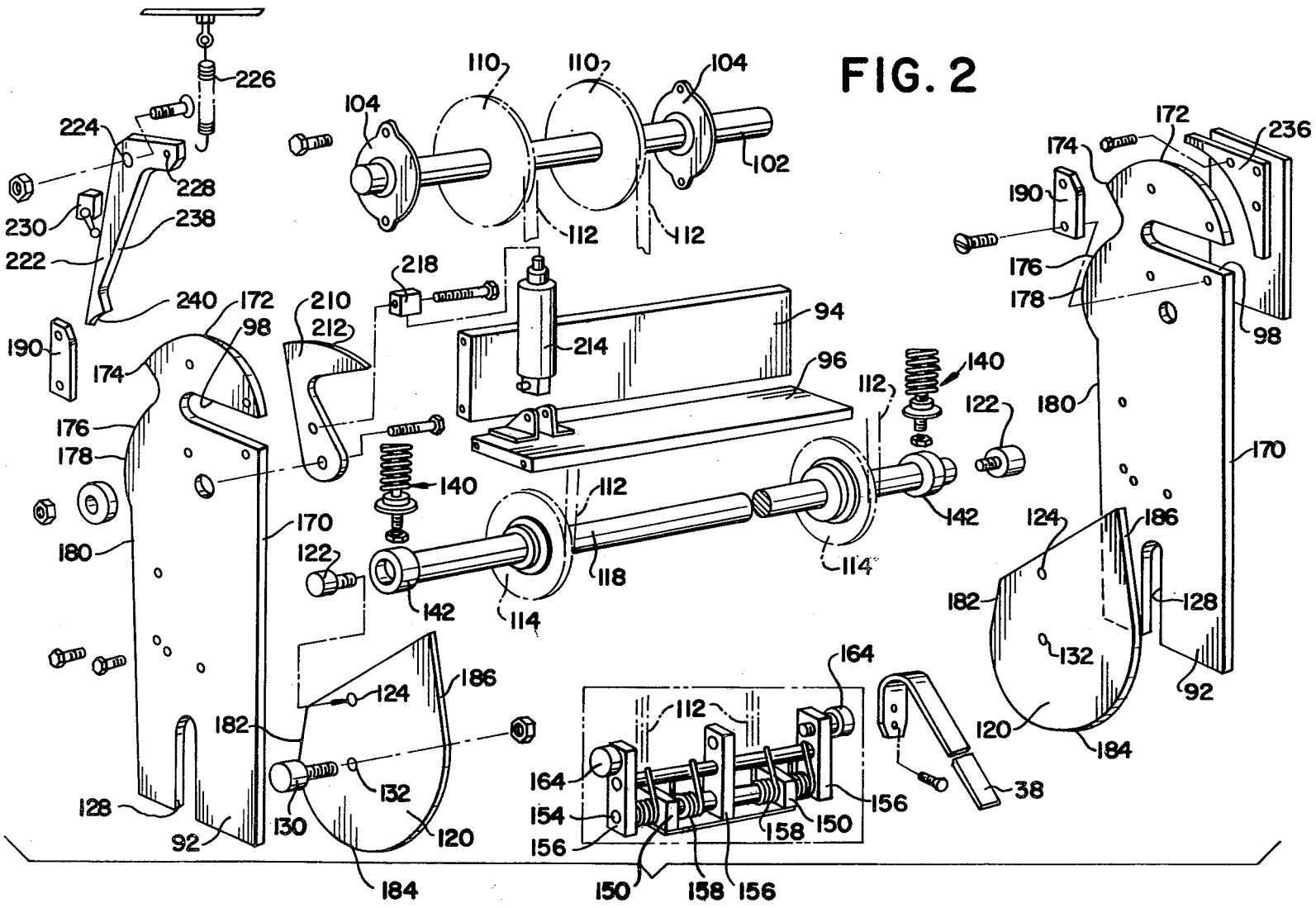
FIG. 2 is a diagrammatic exploded perspective illustration of a drive mechanism used in the stacker apparatus.
Figure 3:
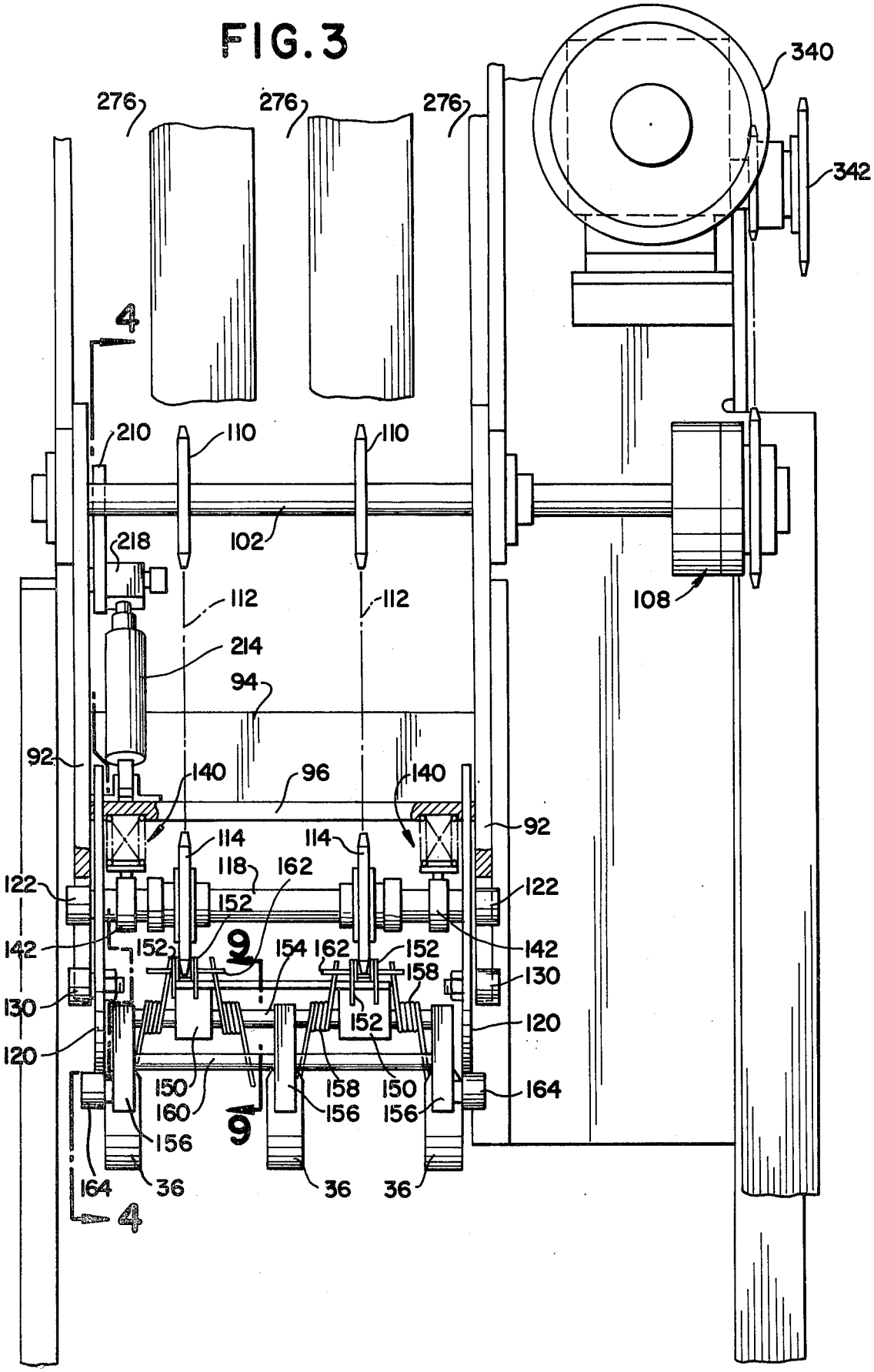
FIG. 3 is a rear elevational view taken generally on lines 3—3 of FIG. 1.

The drive mechanism for the stacker section of the stacker apparatus is shown in FIGS. 2 and 3 as including spaced-apart parallel opposite side plates 92 between which braces 94 and 96 are suitably secured. Slots 98 extend inwardly from the upper rear edges of side plates 92 for receiving a drive shaft 102 having bearing assemblies 104 suitably mounted to side plates 92. Drive shaft 102 is selectively driven by an electromechanical drive clutch 108 in FIG. 3 which is connected with a suitable drive motor. The motor and clutch defines drive means for driving the support means downwardly from the upper elevation thereof. Drive wheels 110 in the form of sprocket wheels are provided on drive shaft 102 for receiving flexible continuous drive elements in the form of roller chains 112 which extend around idler wheels or sprockets 114 on idler shaft 118 positioned between lower side plates 120 located against the inside surfaces of side plates 92. Guiding and retaining members 122 extend freely through suitable holes 124 in plates 120 into tapped bores in the opposite ends of idler shaft 118. Guiding and retaining elements 122 have generally cylindrical enlarged heads slidably received in vertical slots 128 in side plates 92. Additional guiding and retaining elements 130 extend through suitable holes 132 in plates 120 and have enlarged cylindrical heads slidably received in slots 128. This mounting arrangement allows vertical movement of plates 120 relative to plates 92. This also provides movement of guiding and retaining elements 122 and 130 relative to plates 92. Most importantly, idler shaft 118 and its sprockets 114 are vertically movable relative to opposite side plates 92.

Compression spring assemblies 140 have upper end portions received in suitable cylindrical recesses in the under side of brace 96, and have lower portions bearing against collars 142 received on the opposite end portions of idler shaft 118 for normally biasing idler shaft 118 downwardly away from brace 96 to tension roller chains 112 and provide a yieldable dynamic drive system which can absorb energy when decelerated.

Carriers or trucks are secured to chains 112 for attaching support means 34,36 and 38 to the chains. The carriers or trucks may take many forms and in one arrangement include securing portions 150 having spaced-apart plates 152 which replace a pair of links in chains 112 for securing a carrier to the chains. An elongated rod 154 is secured to securing portions 150 and has blocks 156 pivotally mounted thereon. Torsion springs 158 surround rod 154 and have one end bearing against a rod 160 secured to blocks 156, and opposite ends bearing against elongated pins 162 replacing one of the rivets used for securing plates 152 in chains 112. Blocks 156 carry roller cam followers 164. Each support means is shown in the form of a plurality of laterally spaced tines and one tine is secured to each block 156. Thus, in the arrangement shown and described, each support means 34,36 and 38 is formed by three laterally spaced-apart tines secured to the blocks of its carrier or truck assembly. Torsion springs 158 bias blocks 156 in a direction for engaging cam followers 164 with the outer peripheral edges of side plates 92 and 120 which define programmed cam tracks.

The outer peripheral edges of the side plates defining the cam track includes a rear generally straight and vertical rear cam track portion 170, an upper arcuate cam track portion 172 which drops away sharply at 174 to an intercept cam track portion 176 spaced inwardly toward drive shaft 102 and upper sprocket wheels 110. Intercept cam track portion 176 merges into delay cam track portion 178 which merges into generally straight front cam track portion 180. Cam track portion 180 merges into front discharge cam track portion 182 on plates 120 which merges into lower discharge cam track portion 184, and this in turn merges into rear cam track portion 186 which intersects the rear straight cam track portion 170 on plate 92.

Slots 98 in plates 92 are closed by cam track plates 190 having edges corresponding in shape to cam track portions 170 and 172 so that cam followers 164 will smoothly travel past slots 98 by travelling along cam track plates 190.

An outer cam track portion 236 is provided adjacent one of side plates 92 as shown in FIG. 2 spanning the merger between rear cam track portion 170 and upper curved cam track portion 172 for aiding in guiding at least one cam follower during its movement over the upper portions of the cam tracks.

Cam latch means 210 is pivotally attached to one of plates 92 and has a latch cam track 212 which spans and forms a continuation of cam track portions 172 and 178 so that intercept cam track portion 176 is by-passed in the closed position of cam latch means 210. A fluid cylinder 214 suitably mounted on brace 96 has its rod pivotally attached by bracket assembly 218 to cam latch means 210 for moving same from its closed position to its open position wherein cam latch means 210 is pivoted upwardly out of the way of intercept cam track portion 176.

A kicker 222 is mounted on a pivot axis 224 to the frame of the stacker apparatus for movement in a direction toward and away from intercept cam track portion 176. A tension spring 226 is suitably connected to the frame of the apparatus and to an arm portion 228 of kicker 222 for normally pivoting kicker 222 counterclockwise as viewed in FIG. 4. A switch 230 is positioned for operation by kicker 222 for controlling operation of electro-magnetic clutch 108 of FIG. 3.

Kicker 222 has an inner edge 238 and an arcuate inwardly facing lower end portion 240. When cam latch means 210 is in its closed position with latch cam track 212 spanning cam track portions 172 and 178, movement of a cam follower 164 past latch cam track portion 212 causes such cam follower to engage edge 238 of kicker 222 for pivoting same outwardly whereupon switch 230 is operated for disengaging electro-magnetic clutch 108 whereupon drive shaft 102 is no longer driven. The drive mechanism will normally coast slightly so that cam follower 164 will strike a stop means shown in FIG. 4 at 244 in the form of an inclined anvil on the frame of the apparatus. With a cam follower 164 bearing against stop means 244, arcuate inwardly facing lower end portion 240 of kicker 222 firmly engages such cam follower. When counter 40 has counted a sufficient number of papers or other flat articles to form a desired stack, a signal is sent for operating cylinder 214 to pivot cam latch means 210 upwardly so that cam follower 164 can move inwardly against intercept cam track portion 176. Although torsion springs 158 of FIG. 3 normally bias blocks 156 and cam followers 164 inwardly toward the cam track, kicker 222 is provided with a more powerful spring for insuring rapid snap acting movement of blocks 156 and cam followers 164 away from stop means 244 against intercept cam track portion 176.

Once kicker 222 pivots inwardly toward intercept cam track portion 176, switch 230 again closes to engage electro-magnetic clutch 108 so the drive mechanism starts. In the upper position or elevation of a support means shown at 34 in FIG. 4, the support means is movable with intercept motion as shown in the sequence drawings.

Support means 34 moves from its uppermost poised position generally from location E to location G with snap acting intercept motion so that the free outer end of support means 34 intercepts the leading edge of a flat article 32 to begin formation of a new stack while the last articles are still travelling in the stacker apparatus to fall on top of the stack supported on the lower support means. The free outer ends of the support means move with components both perpendicular along sector E-F to the direction of the flat article stream B, and parallel along the direction of flat article movement as represented by sector F-G. As the clutch is engaged and the chains 112 begin moving so that the carrier assembly for support means 34 starts moving downwardly, a plurality of successive positions occupied by rod 154 are identified by numerals 0, 1, 2, 3, and 4. Corresponding positions for the heel of the tine forming support means 34 are marked 0*a*, 1*a* and 2*a*. Corresponding positions for the outer free end of the tines are marked 0*b*, 1*b*, 2*b*, 3*b* and 4*b*. As shown, delay cam track portion 178 is arranged so that initial downward movement of cam follower 164 along delay cam track portion 178 causes the free outer end of the tines to remain in substantially the same elevational position it occupied immediately after movement through its intercept motion. This is because delay cam track portion 178 pivots the support means upwardly while its carrier is moving downwardly so that the free outer end of the tines remains in essentially its same position. This allows free movement of the last papers beneath the tines so they are free to fall onto the stack below after the intercept has been made to begin formation of a new stack. As soon as cam follower 164 moves off of delay cam track portion 178 which defines a mechanical delay means, the free outer end of the tines moves downwardly rapidly along with the entire tine and its carrier to the lower position. When the tine reaches the lower position shown in FIGS. 1 and 4, the next tine and its carrier will have reached kicker 222 for moving same outwardly and opening switch 230 to disengage electro-magnetic clutch 108. The mechanism then waits, if necessary, until the desired number of papers in a stack have been deposited on the tines.

Figure 4:
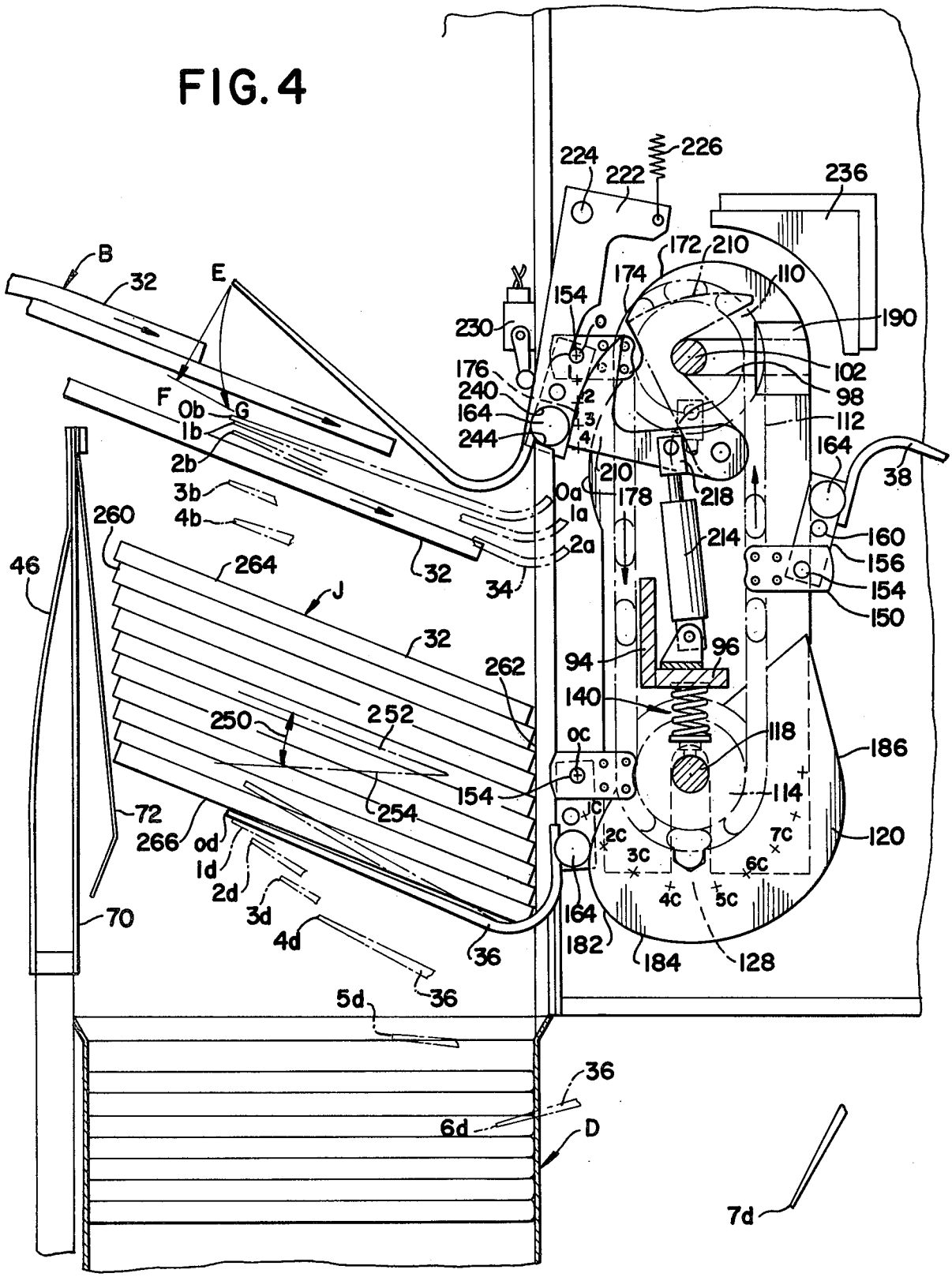
FIG. 4 is a side elevational view taken generally on lines 4—4 of FIG. 3 and with portions cut away for clarity of illustration.

Once a desired number of papers has been received, the poised upper tine moves with intercept motion and the mechanism starts so the lower tine 36 has its free outer end moved as illustrated diagrammatically in FIG. 4. Markings 0*c*–7*c* in FIG. 4 represent positions of rod 154 and corresponding positions at the free outer end of the tines 36 are marked 0*d*–7*d*. Due to the shape of discharge cam track portions 182 and 184 on plates 120, tine 36 beings withdrawing inwardly or laterally away from the stack while also becoming somewhat horizontal. This begins rotational movement of the inclined stack through an angle 250 in FIG. 4 from its normal inclined position 252 to a generally horizontal position 254. The springs 72 and braces 70 of FIG. 1 may engage the trailing edge of the stack for aiding in straightening the papers therein to form a generally rectangular stack. Once rotation and straightening of the stack has started, the tine withdraws extremely rapidly from beneath the stack as shown at *4d–7d* so that the stack drops approximately flat onto the turntable. As is clearly shown, the support means or tines are inclined upwardly slightly from the horizontal during stack formation as it has been found that this is a more reliable and efficient manner of forming a stack from a plurality of flat articles which are intercepted by the stacker apparatus. During their downward movement, the tines extend generally parallel to the direction in which stream B of flat articles 32 moves. Each stack J is generally in the shape of a rhombus in side elevation. Vertical parallel opposite outer and inner stack sides 260 and 262 are intersected by upper and lower surfaces 264,266 which are inclined downardly in a direction from outer side 260 toward inner side 262. When the tines withdraw laterally as in positions *0d–4d*, they remain approximately parallel to their normal stack supporting position, and to upper and lower surfaces 264,266. As the free outer ends of the tines move toward the inner side 262 past the center of gravity of stack J, such stack will begin to rotate counterclockwise in FIG. 4. The tines then withdraw very rapidly laterally and downwardly so the stack reaches the turntable with upper and lower surfaces 264,266 approximately horizontal, or at least more nearly horizontal than if simply dropped without rotation.

Following receipt of a signal from counter 40 to extend the rod of cylinder 214 for moving cam latch means 210 from its closed position to its open position, cylinder 214 can simply be deenergized so it will return to its retracted position under the force of an internal spring. That is, cylinder 214 is simply energized momentarily for extending its rod to move cam latch means 210 to its open position. After momentary energization, the air drains relatively slowly from the cylinder which returns to its retracted position under spring force and returns cam latch means 210 to its closed position against a suitable stop secured to one of said plates 92. By the time cam latch means 210 returns to its closed position, cam follower 164 will have moved down off intercept cam track portion 176.

A support means is capable of moving through its intercept motion over a relatively large range of upper positions. With the support means considered as being movable through a predetermined total downward distance, the uppermost portion of that predetermined distance is one in which the support means can move in its intercept motion. For example, if the counter 40 tells the cylinder 214 to move the cam latch means 210 to its open position before cam follower 164 has reached stop means 244, the necessary action will be carried out and the support means will simply move into its intercept position while cam follower 164 is at a higher location on intercept cam track portion 176. The angle or inclination of intercept cam track portion 176 is such that the free outer end of the support means will occupy approximately the same elevational position regardless of where cam follower 164 moves into engagement with intercept cam track portion 176 along the length thereof. This wider range of distance over which the support means can move through its intercept motion makes it unnecessary to have a fixed geometry wherein the intercept means must be returned to a precise poised position every time. With the arrangement described, the machine is capable of cycling faster because it is not necessary to wait until the cam follower has reached a predetermined poised position against stop means 244. Cam follower 164 can move inwardly into engagement with intercept cam track portion 176 anywhere from abrupt dropoff 174 up to stop means 244 and the free outer end of the support means will still effect the proper intercept action. In other words, the support means is capable of moving with intercept motion before reaching a poised position. When this occurs, the support means simply moves right past the poised position and the stop means.

In the preferred arrangement shown and described, three support platforms 34,36 and 38 are secured in equidistantly spaced relationship around roller chains 112. However, it will be appreciated that a greater or lesser number of supports can be provided depending upon the use to which the apparatus will be put.

Figure 5:
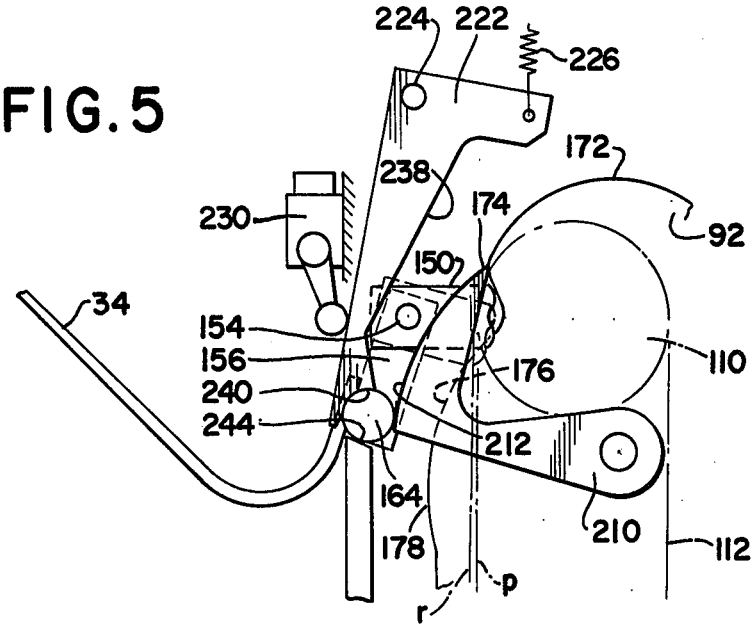
FIG. 5 is a partial side elevational view of a top portion of the mechanism of FIG. 4.
Figure 6:
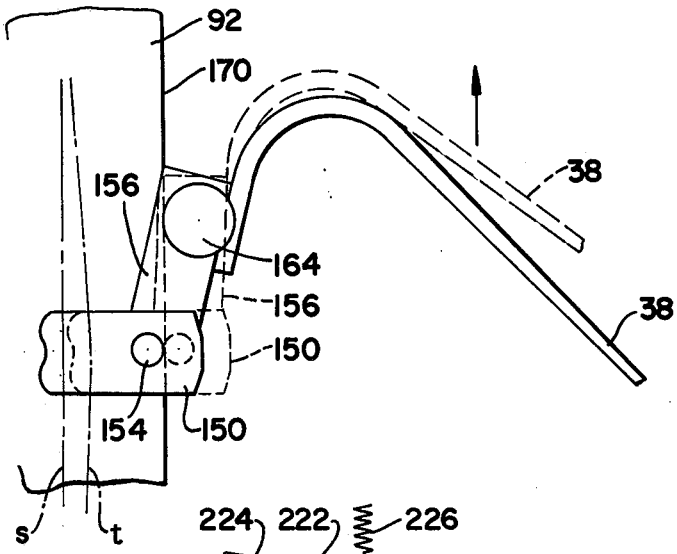
FIG. 6 is a partial side elevational view showing the movement a support platform undergoes when its drive mechanism is stopped.

FIGS. 5 and 6 show some of the dynamics of the drive mechanism provided by the yieldable bottom idler shaft. As a support means and its carrier move over the top of side plates 92, cam follower 164 engages kicker cam surface 238 for pivoting kicker 222 clockwise in FIG. 5 away from side plates 92 for opening switch 230 and disengaging electro-magnetic clutch unit 108 of FIG. 3. The mechanism then coasts somewhat, and usually sufficiently for causing cam follower 164 to strike stop means 244. The center line of the front side of roller chain 112 moves from position p to position r. Carrier 150 rocks from the solid line position to the dotted line position shown due to the momentum of the moving mass when cam follower 164 strikes stop means 244. This action causes spring assemblies 140 of FIG. 2 to compress so that lower idler shaft 118 can move upwardly toward upper drive shaft 102. At the same time this action is occurring, the lower idler sprockets 114 tend to continue rotation and this increases the tension in the front run of the chains so that spring assemblies 140 are also compressed by this action.

On the back side of the drive mechanism, the abrupt stoppage as described with respect to FIG. 5 causes the support means on the rear side of the mechanism to rock abruptly as its mass comes to a halt. The carrier and support means rock from the solid line position to the dotted line position shown in FIG. 6, and the back run of the chain moves from the position shown at s to the position shown at t. This action adds tension on both the front and rear runs of the chains and causes spring assemblies 140 to further compress. The action described provides compression of spring assemblies 140 to absorb and dissipate the energy or momentum of the moving mechanism and these spring assemblies then extend to restore the elements of the mechanism to their normal positions. Downwardly and inwardly facing surface 240 on kicker 222 holds cam follower 164 against the stop means 244 and prevents back lash in the drive mechanism. The drive mechanism uses the principle that energy of a non-rigid rotating mass is more conveniently absorbed and dissipated. With a non-rigid drive mechanism, it is possible to use a very simple clutch assembly 108 rather than the very complex and expensive drive necessary in other stacker apparatus for accelerating and decelerating the moving rigid masses without damaging the various components.

Figure 7:
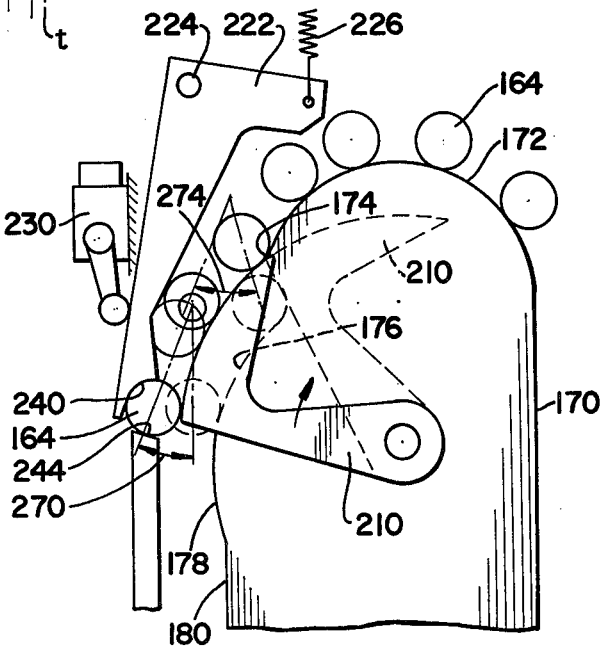
FIG. 7 is a partial side elevational view of a top portion of the drive mechanism showing the travel of a cam follower on a support platform.

FIG. 7 shows the path of a cam follower 164 in reaching a poised position when cam latch means 210 is in its lower closed position or the path taken when cam latch means 210 is in its upper open position. Cam follower 164 moves over upper cam track portion 172 and then downwardly toward stop means 244. Cam follower 164 is capable of moving inwardly toward intercept cam track portion 176 any time in its last several inches of travel toward stop means 244. The normal intercept motion when cam follower 164 is positioned against stop means 244 is indicated by angle 270 in FIG. 7. However, if the cylinder for operating cam latch means 210 receives an earlier signal from the counter for moving cam latch means 210 upwardly to its open position, cam follower 164 can move through the angle indicated at 274, and this moves the corresponding support means in its intercept motion. Obviously, the cam follower can move with intercept motion anywhere between the angles indicated by numerals 274 and 270. This provides a greater range of positions from which a support means can move to an intercept position. Thus, it is not necessary for the support means to reach a precise poised position every time before moving with intercept motion. This makes it possible to operate the mechanism at greater speeds than heretofore possible.

Figure 8:
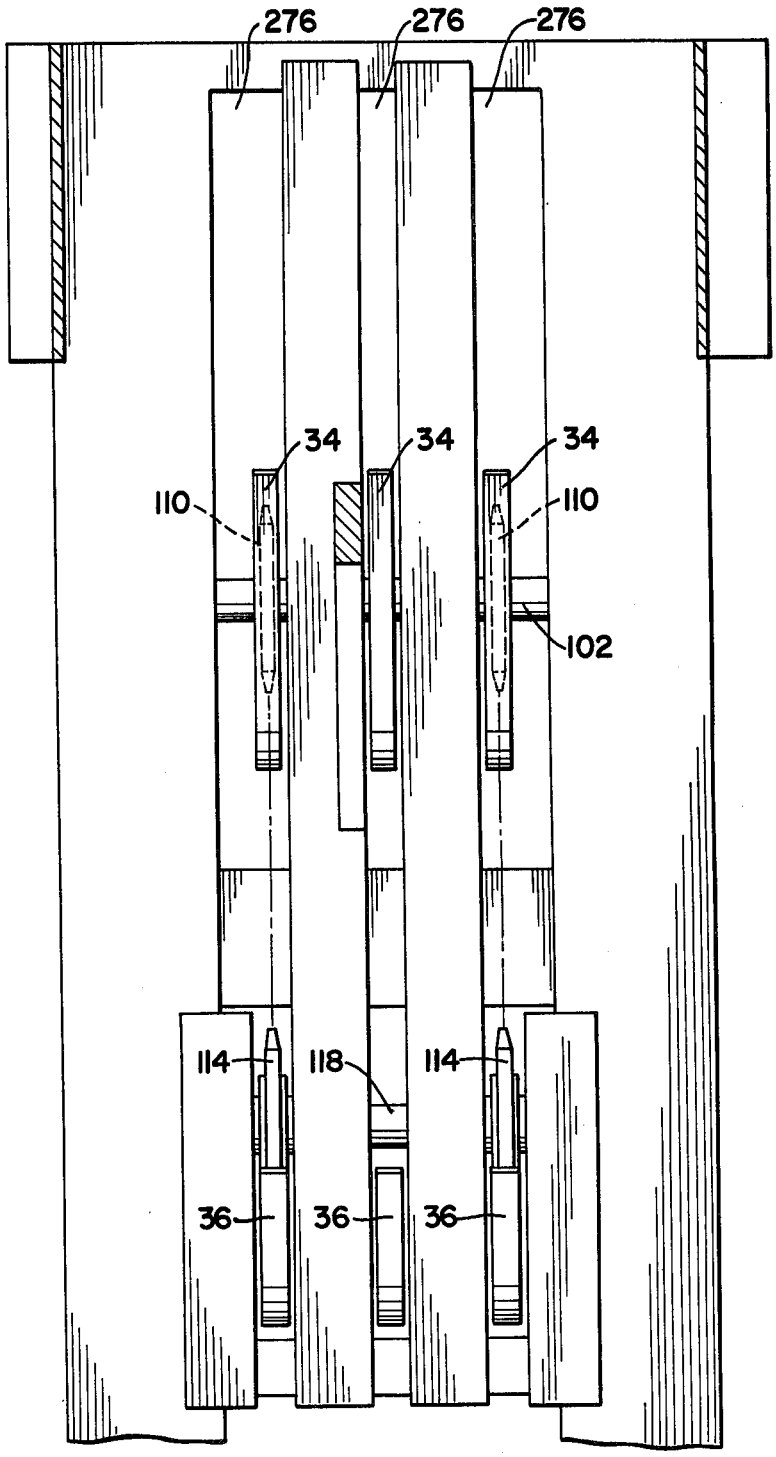
FIG. 8 is a partial cross-sectional elevational view taken generally on lines 8—8 of FIG. 1.
Figure 9:
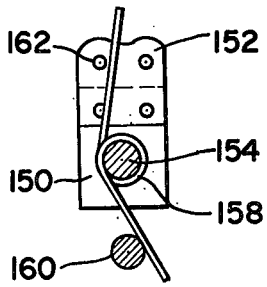
FIG. 9 is a cross-sectional elevational view taken generally on lines 9—9 of FIG. 3.

FIG. 8 shows the stacker section as having spaced-apart vertical slots 276 in its frame and the three laterally spaced-apart tines defining support means 36 extend through the slots.

Figure 10:
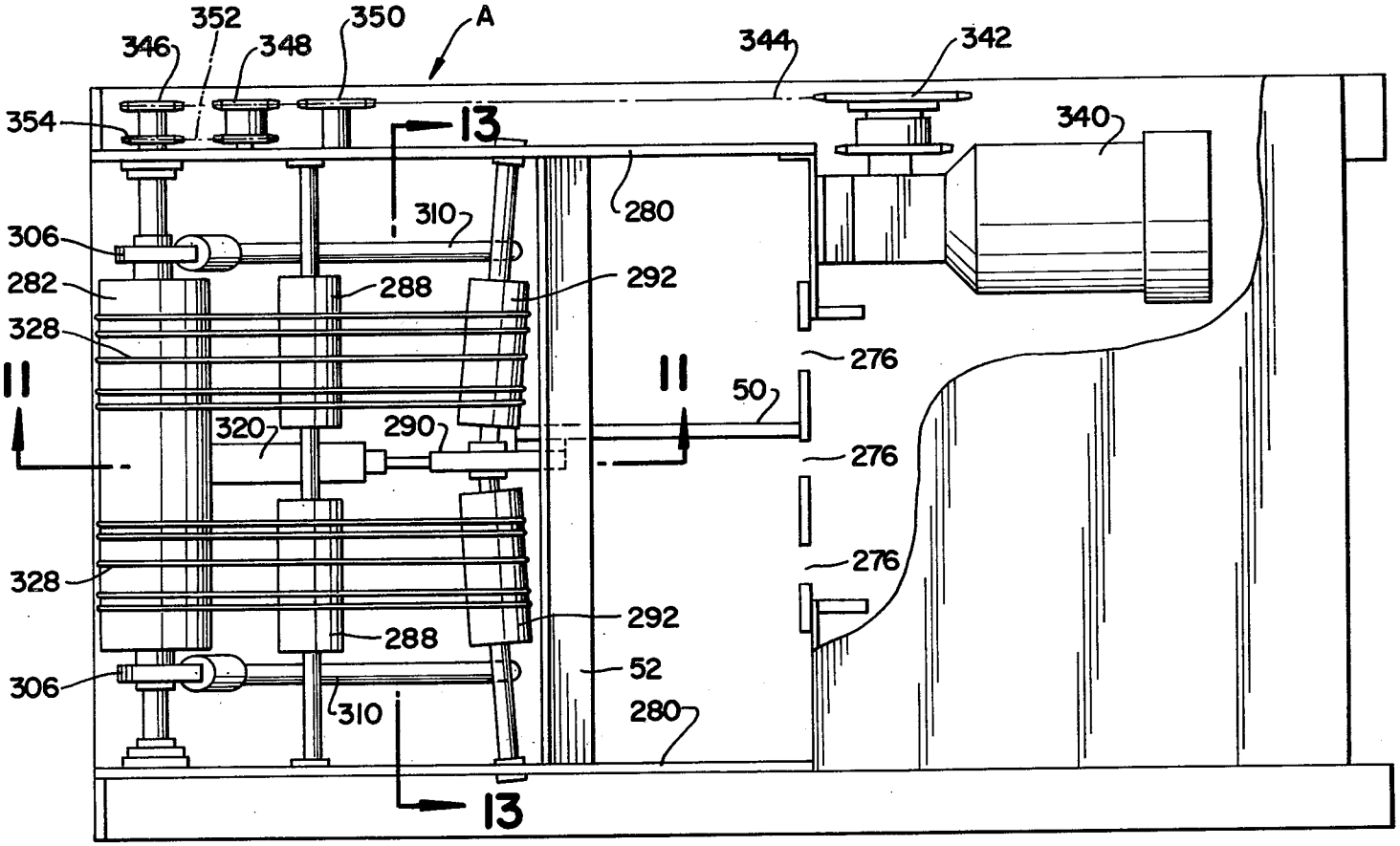
FIG. 10 is a plan view of an input mechanism taken generally on lines 10—10 of FIG. 1.

FIGS. 10–12 show input mechanism A of FIG. 1 as including opposite side plates 280 between which upper and lower rotatably driven rollers 282 and 284 are mounted. Upper roller 282 is driven counterclockwise in FIG. 11, while roller 284 is driven clockwise. Upper intermediate idler rollers 288 are suitably rotatably mounted on a shaft extending between side plates 280. A cross brace member 52 extending between side plates 280 has a combined guide and support 290 secured thereto. As shown in FIG. 11, the surface of guide support 290 facing downwardly and to the left is sloping for guiding the leading folded edges of papers 32 or the like through input mechanism A.

Figure 13:
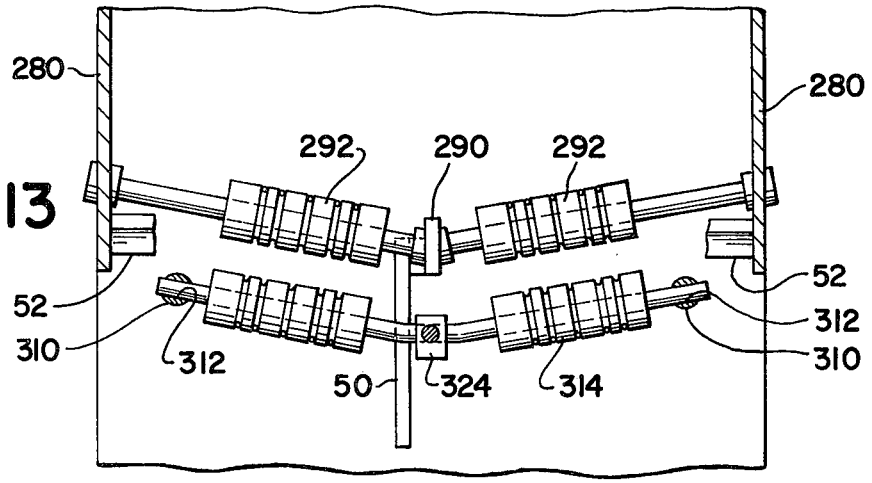

Forward upper V-rollers 292 are rotatably mounted on inclined shafts mounted between side plates 280 and guide support 290. As best shown in FIGS. 10 and 13, V-rollers 292 are inclined downwardly toward the longitudinal centerline of input mechanism A, and are also inclined inwardly slightly from right to left in FIG. 10.

Trunnions 306 are rotatably mounted at the opposite ends of lower drive roller 284 on the shaft rotatably supporting same. Support arms 310 extend downwardly and then horizontally outward from trunnions 306 and have holes 312 supporting the outer ends of shafts on which lower V-rollers 314 are rotatably mounted. A fluid cylinder 320 pivotally secured to the frame of the apparatus by bracket assembly 322 below lower drive roller 284 has a rod connected by a block 324 with the inner ends of the shafts which support lower V-rollers 314. Lower V-rollers 314 are supported in the manner described in adjacent parallel relationship beneath upper V-rollers 292.

All of the rollers described have a plurality of aligned and longitudinally-spaced circumferential grooves therein around which flexible elements such as coil spring wires extend. FIGS. 11 and 12 show coil spring wires 328 extending around upper drive roller 282, idler rollers 288 and upper front V-rollers 292. Coil spring wires 330 extend around lower drive roller 284 and forward lower V-rollers 314. When the rod of cylinder 320 is fully extended, forward lower V-rollers 314 are supported in proper spaced relationship beneath upper V-rollers 292 for feeding stream B of overlapped flat articles 32 to the stacker section for reception and stacking on the support means. Forward lower V-rollers 314, along with trunnions 306, arms 310 and fluid cylinder 320, define a dump gate for deflecting flat articles away from the support means in the event a jam condition occurs. Although only one jam sensing means has been described with respect to switch 48 and the spring 56 in FIG. 1, it will be recognized that other jam sensing switches may be provided for sensing other jam conditions or misalignment of papers in the moving stream for operating the dump gate for moving same between its normal upper feeding position and its lower dumping position. In the normal upper position of the dump gate, stream B of flat articles 32 moves over the top of deflector means 46 in FIG. 1 for reception and formation into a stack on the support means. However, when a jam condition is sensed, the rod of cylinder 320 is retracted for swinging trunnions 306 and moving arms 310 downwardly to lower forward V-rollers 314 so that stream B strikes against deflector means 46 before reaching the support means. When a jam condition has been corrected, as when the electro-magnetic clutch engages for moving the support means downwardly away from jam sensing switch 48, cylinder 320 may automatically operate for automatically moving the dump gate back to its upper feeding position. When the dump gate is in its lower dumping position, papers are not counted by the counter so that an approximate proper number of papers will be provided in a stack even though the dump gate has been operated. In view of the fact that the counter does not count when the dump gate is moved to a dumping position, the stacker section and its drive mechanism will not operate because no signals will be received from the counter.

FIGS. 1 and 10 show a drive motor 340 for rotatably driving the rollers of input mechanism A and for driving the electro-magnetic clutch connected to upper drive shaft 102 of FIG. 2. A motor sprocket 342 has a roller chain 344 extending therearound, and around a suitable sprocket 346 on the shaft for upper drive roller 282. Chain 344 extends back in engagement with idler sprockets 348 and 350. A roller chain 352 connects sprocket 348 with a sprocket 354 on the shaft of lower drive roller 284. A chain may be suitably connected from motor sprocket 342 to drive the input side of the electro-magnetic clutch 108 of FIG. 3.

Jam sensing switch 48 of FIG. 1, and other jam sensing means, may simply be connected in series with a double-acting solenoid valve having a normal position in which the rear end of double acting cylinder 320 is connected to air pressure and the forward end connected to exhaust. Thus, air cylinder 320 would normally always be connected to the source of air pressure for extending same and holding the dump gate in its upper article feeding position. Upon closing of any jam sensing switch, the solenoid valve would move to a position venting the rear end of the cylinder to atmosphere and connecting its forward end to the source of air pressure. This would cause retraction of the double-acting cylinder 320 for lowering the dump gate to the dumping position shown in FIG. 12 so that the steam B of flat articles 32 would be deflected away from the support means. When the jam condition no longer exists, opening of the jam sensing switch will automatically cause shuttling of the solenoid valve back to its normal position in which the rear end of double acting cylinder 320 is connected to the source of air pressure, while its forward end is open to exhaust so that the dump gate is automatically moved back to its upper feeding position.

The drive control means defined by switch 230 for operation by kicker 222 can simply be a limit switch connected in series with electro-magnetic clutch 108. Normally closed switch 230 is opened by pivotal movement of kicker 222 moving outwardly when a cam follower engages same in moving toward stop means 244. Movement of latch means 210 to its upper opened position causes movement of the cam follower and kicker 222 so that the drive control means defined by limit switch 230 closes to engage the electro-magnetic clutch 108 and start the drive mechanism.

Counter 40 may be of a known type and may simply be a decade counter for counting any desired number of flat articles before sending a pulse or signal to an electrical gate through which current is supplied to an electrically operated valve which opens at least momentarily for supplying air pressure to air cylinder 214 to operate latch means 210 from its closed position to its open position. Obviously, many other controls and operating arrangements are possible and those described are intended only for purposes of illustration and are not to be taken in a limiting sense. After the counter has supplied a pulse, it simply resets and again starts counting with the next paper so it is ready to supply another pulse when another desired number of papers have been counted for forming a stack.

Each support means is movable from an upper elevation shown by the solid line showing of support means 34 in FIG. 1 to an intercept position shown by the dotted line position of support means 34. Each support means moves through this intercept motion from an upper elevation with snap action very rapidly. Each support means then moves downwardly with stack forming motion toward the position occupied by support means 36 and the stack forming motion is different from the intercept motion. The intercept motion includes pivotal movement of the support means, while the stack forming motion provides substantially linear downward movement of the support means. Each support means moves relative to its carrier or truck when moving through its intercept motion, and moves with its carrier through the stack forming motion. The delay means for delaying downward movement of the free outer end of a support means is provided by delay cam track portion 178 of FIG. 2. This provides a mechanical delay in which the support means is being pivoted upwardly at substantially the same rate its carrier is moving downwardly with the stacker drive mechanism so that the free outer end of the support means remains at substantially the same elevation for a short time in order to allow the last papers of a previous stack to clear the next support means which has moved with intercept motion to begin formation of a new stack. The cam track defined by the various cam portions on plates 92 and 120 of FIG. 2 is a programmed cam track which provides the described motions and movements of the support means. The cam followers on the support means are constantly biased by yieldable biasing means into engagement with the programmed cam track so the mechanism is very quiet and is accurate in operation.

The discharge cam track portion on lower side plates 120 of FIG. 2 provides programmed movement of the support means in its discharge motion. The free outer end of the support means moves inwardly toward the inner side of a stack generally parallel to the upper and lower stack surfaces until the free end portion is toward the stack inner side from the stack center of gravity. This causes the stack to begin rotation counterclockwise for bringing its upper and lower surfaces generally horizontal. At this time, the tines drop away extremely rapidly in a downward and lateral direction so the stack free falls downwardly onto the turntable in a generally rectangular shape. The leaf springs 72 and braces 70 of FIG. 1 may aid in shifting the stack at this time if so desired for aiding in bringing same into a generally rectangular position from its rhombus shape.

Input mechanism A feeds stream B of overlapped flat articles 32 downwardly at a relatively small angle to the horizontal so the stream moves in a predetermined direction along a feed path. The flat articles move generally flatways as they move into the stacker section. The stacker section is positioned so the stream of articles move transversely thereto. The tines defining the support means extend generally parallel to the direction of stream movement as the tines move downwardly with stack forming motion. The papers may fall by gravity downwardly onto the stack after the leading edge of such papers strikes the frame portion in which the slots 276 of FIG. 8 are formed.

The free outer end of a tine moves with precision between two adjacent overlapped flat articles for catching the leading edge of one and separating same from the next lower article so a new stack can be initiated. Downward movement of the free outer end of a tine is delayed mechanically by the programmed cam track in order to allow the last papers to clear the tine which is now located in its intercept position.

The V-rollers 292 and 314 impart somewhat of a V-shaped bend to the flat articles moving therebetween so that the articles free fall onto a support means in the stacker section with greater accuracy. The drive mechanism for the stacker section includes flexible drive elements defined by the roller chains and these extend around wheels which are sprocket wheels when roller chains are used. The lower idler wheels are yieldably biased away from the upper drive wheels for maintaining the flexible drive elements under tension and for absorbing energy during deceleration of the drive mechanism.

Although the invention has been shown and described with respect to a preferred embodiment, it is obvious that equivalent alterations and modifications will occur to others skilled in the art upon the reading and understanding of this specification. The present invention includes all such alterations and modificiations, and is limited only by the scope of the claims.

Having thus described my invention, I now claim:

1. Stacker apparatus comprising: bottom support means movable downwardly from an upper position for receiving and forming a stack of flat articles moving generally flatways one after another transversely toward said stacker apparatus, said support means in said upper position being first movable generally downwardly with snap acting intercept motion for intercepting the leading edge of a flat article and beginning formation of a new stack of such articles, said support means then being movable downwardly with stack forming motion different from said intercept motion, said support means being movable substantially more rapidly with said intercept motion than with said stack forming motion, and said intercept motion and said stack forming motion also being substantially different from one another by motion characteristics other than speed.

2. The stacker apparatus as defined in claim 1 wherein said support means has a free outer end movable during said intercept motion with components both perpendicular and parallel to the direction of movement of the flat articles.

3. The stacker apparatus as defined in claim 1 wherein said support means is attached to a movable carrier and moves relative to said carrier through said intercept motion and moves with said carrier through said stack forming motion.

4. The stacker apparatus as defined in claim 1 wherein said support means moves downwardly through a predetermined total distance and said upper position in which said support means is capable of movement in said intercept motion extends over the uppermost portion of said predetermined total distance.

5. The stacker apparatus as defined in claim 1 wherein said support means is pivoted to a carrier and has a free outer end, said support means having a cam follower engaging a programmed cam track for controlling pivotal movement of said support means relative to said carrier to delay toward movement of said free outer end with said carrier and support means immediately following movement of said support means in said intercept motion.

6. The stacker apparatus as defined in claim 1 wherein said support means supports a plurality of flat articles in a stack having upper and lower stack surfaces and moves in discharge motion following movement thereof in said stack forming motion, said support means in said discharge motion first moving gradually laterally relative to said stack generally parallel to said stack surfaces to partially withdraw from supporting relationship to a stack of flat articles thereon and then moving sharply laterally and downwardly to completely withdraw from supporting relationship to a stack of flat articles thereon.

7. The stacker apparatus as defined in claim 6 wherein said support means is pivoted to a carrier and has a cam follower engaging a programmed discharge cam track for so moving said support means in said discharge motion.

8. The stacker apparatus as defined in claim 1 including an input mechanism for feeding a stream of flat articles generally flatways toward said support means, said input mechanism including upper and lower portions between which flat articles are fed directly to said support means, said lower portion defining a dump gate movable relative to said upper portion between feeding and dumping positions for dumping flat articles prior to reception of same on said support means in the event of a jam in said apparatus.

9. The stacker apparatus as defined in claim 8 including deflector means positioned in front of said support means, said infeed mechanism being positioned for feeding flat articles to said support means over the top of said deflector means in said feeding position of said dump gate and for feeding articles against said deflector means in said dumping position of said dump gate.

10. The stacker apparatus as defined in claim 8 including jam sensing means for sensing a jam condition in said apparatus and automatically moving said dump gate to said dump position, said jam sensing means being automatically operative to return said dump gate to said feeding position when the jam condition is eliminated.

11. Stacker apparatus for receiving flat articles moving in a stream generally flatways one after another along a feed path in a predetermined direction and forming same into a stack comprising: stack bottom support means for supporting the bottom of a stack, said support means being elongated and having a free outer end, said support means being movable generally vertically downwardly transversely of said predetermined direction from an upper position while extending generally parallel to said predetermined direction for receiving and stacking the flat articles, said support means in said upper position thereof being movable with intercept motion in which said free end moves both toward said feed path and generally along said feed path in said predetermined direction from one location above the feed path to a location between adjacent ones of the flat articles.

12. The stacker apparatus as defined in claim 11 wherein movement of said support means with intercept motion moves said free end thereof in an arcuate path.

13. The stacker apparatus as defined in claim 11 including drive means for moving said support means generally vertically downwardly, and power means independent of said drive means for moving said support means in said intercept motion.

14. The stacker apparatus as defined in claim 11 including latch means cooperating with said support means for holding same against movement with said intercept motion in a closed position of said latch means and for providing movement of said support means with said intercept motion in an open position of said latch means.

15. The stacker apparatus as defined in claim 11 wherein said support means moves with snap action in said intercept motion.

16. The stacker apparatus as defined in claim 11 including drive control means operated by movement of said support means in said intercept motion to start said drive means, and mechanical delay means for delaying downward movement of said free end of said support means after energization of said drive means.

17. Stacker apparatus for stacking flat articles such as newspapers and the like comprising: a plurality of spaced-apart support tines movable successively generally vertically downwardly from an upper elevation for forming successive stacks of flat articles and returning to said upper elevation subsequent to dropping the stacks at a lower discharge elevation, said upper elevation including a stopped poised position from which each said support tine is movable generally downwardly with intercept motion to an intercept position for initiating formation of a new stack of flat articles and then moving downwardly to complete formation of the stack, and each said support tine being movable with said intercept motion to said intercept position over a range of positions while moving toward said poised position and prior to reaching same.

18. The stacker apparatus as defined in claim 17 including stop means for stopping each said tine in said poised position in the event the tine has not moved with said intercept motion prior to reaching said poised position, and each said tine being movable automatically past said stop means in the event the tine has moved with said intercept motion prior to reaching said poised position.

19. The stacker apparatus as defined in claim 17 including latch means movable between a closed position for guiding each said tine to said poised position and an open position for freeing each said tine for movement with said intercept motion prior to reaching said poised position and then bypassing said poised position.

20. Stacker apparatus comprising: bottom support means movable downwardly from an upper elevation for receiving flat articles and forming same into a stack, an input mechanism for feeding a stream of flat articles generally flatways toward said support means, said input mechanism including upper and lower portions between which flat articles are fed directly to said support means, said lower portion defining a dump gate movable relative to said upper portion between feeding and dumping positions for selectively dumping flat articles away from said support means in the event of a jam in said apparatus.

21. The stacker apparatus as defined in claim 20 including deflector means positioned in front of said support means, said infeed mechanism being positioned for feeding flat articles to said support means over the top of said deflector means in said feeding position of said dump gate and for feeding articles against said deflector means in said dumping position of said dump gate.

22. The stacker apparatus as defined in claim 20 including jam sensing means for sensing a jam condition in said apparatus and automatically moving said dump gate to said dumping position, said jam sensing means being automatically operative to return said dump gate to said feeding position when the jam condition is eliminated.

23. Stacker apparatus comprising: a plurality of spaced-apart support platforms movable downwardly from an upper elevation for receiving flat articles moving generally flatways and forming same into successive stacks, said platforms in said upper elevation being movable with intercept motion for initiating formation of a new stack and being movable with discharge motion in a lower elevation for dropping stacks therefrom, said platforms being pivotally attached to carriers mounted on drive elements, said support platforms having cam followers engaging a programmed cam track for guiding and pivoting said support platforms relative to said carriers, and yieldable biasing means acting between said carriers and support platforms for normally pivoting said support platforms relative to said carriers in a direction for positively engaging said cam followers with said cam track.

24. The stacker apparatus as defined in claim 23 wherein said cam track includes an intercept cam track portion for pivoting said support platforms relative to said carriers with snap action in said intercept motion.

25. Stacker apparatus comprising: bottom support means movable downwardly from an upper position for receiving and forming a stack of flat articles moving generally flatways one after another transversely toward said stacker apparatus, said support means in said upper position being first swingable generally downwardly in an arcuate path with snap acting intercept motion for intercepting the leading edge of a flat article and beginning formation of a new stack of such articles, and said support means then being movable downwardly linearly with stack forming motion.

26. The stacker apparatus as defined in claim 25 wherein said support means is attached to a driven continuous chain for linear movement therewith in said stack forming motion and for pivotal movement relative thereto in said intercept motion.

27. Stacker apparatus comprising: bottom support means movable downwardly from an upper position for receiving and forming a stack of flat articles moving generally flatways one after another transversely toward said stacker apparatus, said support means in said upper position being first movable generally downwardly with snap acting intercept motion for intercepting the leading edge of a flat article and beginning formation of a new stack of such articles, said support means then being movable downwardly with stack forming motion different from said intercept motion, said support means being attached by a carrier to a continuous flexible drive element extending around upper and lower wheels, drive means for rotatably driving at least one of said wheels, a fixed cam track generally following said drive element, said support means being pivoted to said carrier and having a cam follower, biasing means normally biasing said support means in a direction for engaging said cam follower with said cam track, said cam track extending sharply inwardly toward said upper wheel to define an intercept cam track portion facing generally toward the direction from which the flat articles move toward said stacker apparatus, and said support means being movable in said intercept motion when said cam follower falls off said cam track onto said intercept cam track portion.

28. The stacker apparatus as defined in claim 27 including cam latch means movable between a closed position continuing said cam track past said intercept cam track portion to block movement of said cam follower onto said intercept cam track portion and an open position providing free movement of said cam follower onto said intercept cam track portion.

29. The stacker apparatus as defined in claim 28 including drive control means operated for stopping said drive means upon movement of said cam follower onto said cam latch means when said cam latch means is in said closed position and being operated for starting said drive means upon movement of said cam follower onto said intercept cam track portion with said cam latch means in said open position.

30. The stacker apparatus as defined in claim 29 including stop means for engagement by said cam follower outwardly of said intercept cam track portion for holding said support means in a poised position for movement through said intercept motion when said cam latch means moves to said open position.

31. The stacker apparatus as defined in claim 30 including kicker means for biasing said cam follower off said stop means toward said intercept cam track portion when said cam latch means moves to said open position.

32. Stacker apparatus for stacking flat articles such as newspapers and the like comprising: a plurality of spaced-apart support tines movable successively generally vertically downwardly from an upper elevation for forming successive stacks of flat articles and returning to said upper elevation subsequent to dropping the stacks at a lower discharge elevation, said tines having free outer ends and being movable in said upper elevation with downwardly pivotal intercept motion to initiate downward movement of said tines and to locate said free outer ends in an intercept position for initiating formation of a new stack of flat articles, mechanical delay means for delaying downward movement of said free outer ends from said intercept position for allowing free movement of the last papers forming a previous stack to move past said free outer ends, and said delay means operating by pivoting said tines upwardly during initial downward movement thereof following movement thereof with said intercept motion for maintaining said free outer ends at substantially the same elevation for a short period of time following location thereof in said intercept position.

33. Stacker apparatus for stacking flat articles such as newspapers and the like comprising: a plurality of spaced-apart support tines movable successively generally vertically downwardly from an upper elevation for receiving flat articles and forming same into stacks, a drive mechanism including upper and lower shafts mounted on side plates having programmed can tracks on the periphery thereof, said side plates including lower plates attached to said lower shaft, a pair of spaced-apart drive sprocket wheels on said upper shaft, a pair of spaced-apart idler sprocket wheels on said lower shaft, a pair of roller chains extending around said upper and lower sprocket wheels, yieldable biasing means for yieldably biasing said lower shaft and lower plates away from said upper shaft for maintaining said chains under tension and absorbing energy during deceleration of said drive mechanism, said lower plates having discharge cam tracks thereon, and said tines having cam followers thereon cooperating with said cam tracks.

* * * * *